US010600366B2

(12) United States Patent
Mao

(10) Patent No.: US 10,600,366 B2
(45) Date of Patent: Mar. 24, 2020

(54) OLED DRIVING CIRCUIT AND AMOLED DISPLAY PANEL

(71) Applicant: Wuhan China Star Optoelectronics Semiconductor Display Technology Co., Ltd., Wuhan, Hubei (CN)

(72) Inventor: Peng Mao, Guangdong (CN)

(73) Assignee: WUHAN CHINA STAR OPTOELECTRONICS SEMICONDUCTOR DISPLAY TECHNOLOGY CO., LTD., Wuhan (CN)

( * ) Notice: Subject to any disclaimer, the term of this patent is extended or adjusted under 35 U.S.C. 154(b) by 236 days.

(21) Appl. No.: 15/745,095

(22) PCT Filed: Nov. 30, 2017

(86) PCT No.: PCT/CN2017/114035
§ 371 (c)(1),
(2) Date: Jan. 15, 2018

(87) PCT Pub. No.: WO2019/095441
PCT Pub. Date: May 23, 2019

(65) Prior Publication Data

US 2019/0385527 A1 Dec. 19, 2019

(30) Foreign Application Priority Data

Nov. 15, 2017 (CN) ..... 2017 1 1130082

(51) Int. Cl.
*G09G 3/3258* (2016.01)

(52) U.S. Cl.
CPC ... *G09G 3/3258* (2013.01); *G09G 2300/0426* (2013.01); *G09G 2300/0819* (2013.01); *G09G 2320/0233* (2013.01)

(58) Field of Classification Search
CPC combination set(s) only.
See application file for complete search history.

(56) References Cited

U.S. PATENT DOCUMENTS

2012/0139957 A1 6/2012 Choi
2018/0204899 A1* 7/2018 Her ..... H01L 27/3262
2018/0366062 A1* 12/2018 Kim ..... G09G 3/3233

FOREIGN PATENT DOCUMENTS

CN 104282263 A 1/2015
CN 104282268 A 1/2015
(Continued)

*Primary Examiner* — Deeprose Subedi
(74) *Attorney, Agent, or Firm* — Hemisphere Law, PLLC; Zhigang Ma

(57) ABSTRACT

An OLED driving circuit comprises an OLED, a switching TFT and a driving TFT; a first terminal of the switching TFT receives a data voltage, a second terminal of the switching TFT is electrically connected to a gate of the driving TFT, a gate of the switching TFT receives a nth scan signal, and n is an integer greater than or equal to 2; a first terminal of the driving TFT receives a source voltage, a second terminal of the driving TFT is electrically connected to a positive electrode of the OLED, and a negative electrode of the OLED receives a low potential voltage; wherein, the OLED driving circuit further comprises an offset capacitor and an offset TFT set for offsetting variations of a driving current of the OLED caused by shifting of a threshold voltage of the driving TFT and a voltage drop of the source voltage.

12 Claims, 3 Drawing Sheets

(56) References Cited

FOREIGN PATENT DOCUMENTS

| | | | |
|---|---|---|---|
| CN | 104575377 | A | 4/2015 |
| CN | 105609052 | A | 5/2016 |
| CN | 106448554 | A | 2/2017 |
| CN | 106601191 | A | 4/2017 |

* cited by examiner

OLED DRIVING CIRCUIT AND AMOLED DISPLAY PANEL

RELATED APPLICATIONS

The present application is a National Phase of International Application Number PCT/CN2017/114035, filed on Nov. 30, 2017, and claims the priority of China Application No. 201711130082.1, filed on Nov. 15, 2017.

FIELD OF THE DISCLOSURE

The disclosure relates to a display driving technical field, and more particularly to an OLED driving circuit and AMOLED display panel.

BACKGROUND

Organic Light-Emitting Diode (OLED) display panels are favored by people because of having characteristics such as thin, power saving, wide viewing angle, wide color gamut, high contrast, etc. The OLED display panels are divided into Passive Matrix OLED display panels (PMOLED) and Active Matrix OLED display panels (AMOLED). The OLED driving circuit generally used in the AMOLED are shown in FIG. 1. The OLED driving circuit is used for driving the OLED and comprises a switch thin film transistor (switch TFT) T2, a driver TFT T1 and a storage capacitor Cst, which is also referred to as a 2T1C structure. The gate of the switch TFT T2 receives an nth scan signal Scan(n), the drain of the switch TFT T2 receives data voltage Vdata, and the source of the switch TFT T2 is electrically connected to the gate of the driver TFT T1. The transmission path between the source of the switch TFT T2 and the drain of the switch TFT T2 is turned on or off under control of the nth scan signal Scan(n). When the transmission path between the source of the switch TFT T2 and the drain of the switch TFT T2 is turned on under control of the nth scan signal Scan(n), the data voltage Vdata is transmitted to the gate of the driver TFT T1. The source of the driver TFT T1 is electrically connected to a source voltage VDD, the source voltage VDD is a high potential voltage, and the drain of the driver TFT T1 is electrically connected to the positive electrode of the OLED. The negative electrode of the OLED is electrically connected to a low potential voltage VSS. The two terminals of the storage capacitor Cst are electrically connected to the gate of the driver TFT T1 and the drain of the driver TFT T1, respectively. The current $I_{OLED}$ flows through the OLED is:

$$I_{OLED}=k(Vgs-Vth)^2$$

Wherein, $I_{OLED}$ is the current flow through the OLED and also referred to as the driving current of the OLED; k is a current amplifying coefficient of the driver TFT T1 and determined by the characteristics of the driver TFT T1; Vgs is the voltage between the gate and the source of the driver TFT T1; Vth is the threshold voltage of the driver TFT T1. It can be understood that the driving current of the OLED is related to the threshold voltage Vth of the driver TFT T1. Because the threshold Vth of the driver TFT T1 is easily shifted, the driving current $I_{OLED}$ of the OLED varies accordingly. The variation of the driving current $I_{OLED}$ of the OLED results in variation of luminance of the OLED, and the display quality of the AMOLED display panel is affected accordingly. Furthermore, voltage drop of the source voltage VDD occurs because of long-distance transmission. Therefore, the driving current IOLED flow through the OLED is varied, which is called as IR drop, and the illuminance of the OLED is varied and the display quality of the OLED display panel is affected, too.

SUMMARY

The technique issue to be solved by the embodiments of the present invention is to provide an OLED driving circuit and AMOLED display panel which could solve the issue of non-uniform illuminance of the OLED caused by threshold voltage shifting of the driving TFT and voltage drop of the source voltage.

In order to solve the technique issues above, a first embodiment of the present invention provides an OLED driving circuit, comprising an OLED, a switching TFT and a driving TFT; wherein a first terminal of the switching TFT receives a data voltage, a second terminal of the switching TFT is electrically connected to a gate of the driving TFT, a gate of the switching TFT receives a nth scan signal, and n is an integer greater than or equal to 2; a first terminal of the driving TFT receives a source voltage, a second terminal of the driving TFT is electrically connected to a positive electrode of the OLED, and a negative electrode of the OLED receives a low potential voltage; wherein, the OLED driving circuit further comprises an offset capacitor and an offset TFT set for offsetting variations of a driving current of the OLED caused by shifting of a threshold voltage of the driving TFT and a voltage drop of the source voltage.

Wherein, the offset capacitor comprises a first storage capacitor and a second storage capacitor, the first storage capacitor is serially connected with the second storage capacitor, a first electrode of the first storage capacitor is electrically connected to the gate of the driving TFT, a second electrode of the first storage capacitor is electrically connected to a first electrode of the second storage capacitor, and a second electrode of the second storage capacitor receives the source voltage.

Wherein, the offset TFT set comprises a third offset TFT, a fourth offset TFT, a fifth offset TFT and a sixth offset TFT; a first terminal of the third offset TFT is electrically connected to the second terminal of the switching TFT, a second terminal of the third offset TFT is electrically connected to the positive electrode of the OLED, and a gate of the third offset TFT receives a (n−1)th scan signal; a first terminal of the fourth offset TFT receives a reference voltage, a second terminal of the fourth offset TFT is electrically connected to the second terminal of the switching TFT, and a gate of the fourth offset TFT receives the (n−1)th scan signal; a first terminal of the fifth offset TFT receives the source voltage, a second terminal of the fifth offset TFT is electrically connected to the first electrode of the second storage capacitor, and a gate of the fifth offset TFT receives an enable signal; a first terminal of the sixth offset TFT is electrically connected to the first electrode of the second storage capacitor, a second terminal of the sixth offset TFT is electrically connected to the first terminal of the driving TFT, and a gate of the sixth offset TFT receives a reverse signal; wherein the reverse signal is reverse of the nth scan signal.

Wherein, a cycle of the OLED driving circuit comprises a reset period, a threshold voltage obtaining period, a writing period and an illuminating period; wherein, in the reset period and the threshold voltage obtaining period, the fifth offset TFT is turned off, the third offset TFT, the fourth offset TFT and the sixth offset TFT are turned on, and the driving TFT is turned off until a voltage between the first terminal and the gate of the driving TFT is the same as the threshold voltage of the driving TFT;

in the writing period, the fourth offset TFT is turned off, the switching TFT is turned on, and the data voltage is transmitted to the gate of the driving TFT and stored in the first storage capacitor, in the illuminating period, the fifth offset TFT and the sixth offset TFT are turned on, the driving TFT is turned on, the OLED illuminates, and a formula for calculating the driving current IOLED is:

$$I_{OLED} = K\left[\frac{C_1}{C_1 + C_2} \times (Vdata - Vref)\right]^2;$$

wherein, K is a current amplifying coefficient of the driving TFT, Vdata is the data voltage, and Vref is the reference voltage.

Wherein, the switching TFT, the driving TFT, the third offset TFT, the fourth offset TFT, the fifth offset TFT and the sixth offset TFT are all N-type TFT's or all P-type TFT's.

Wherein, a difference between the source voltage and the reference voltage is greater than the threshold voltage of the driving TFT.

Wherein, in the writing period, a voltage between the first storage capacitor and the second storage capacitor is:

$$Vref - Vth + \left(\frac{C_2}{C_1 + C_2} \times (Vdata - Vref)\right);$$

wherein, Vref is the reference voltage, Vth is the threshold voltage of the driving TFT, C1 is a capacitance of the first storage capacitor, C2 is a capacitance of the second storage capacitor, and Vdata is the data voltage.

Wherein, in the illuminating period, a voltage of the gate of the driving TFT affected by coupling effect of the first storage capacitor is:

$$\frac{C_1}{C_1 + C_2} \times (Vdata - Vref) + VDD + Vth;$$

wherein, C1 is a capacitance of the first storage capacitor, C2 is a capacitance of the second storage capacitor, Vdata is the data voltage, Vref is the reference voltage, VDD is the source voltage, and Vth is the threshold voltage of the driving TFT.

Wherein, the first terminal is source and the second terminal is drain, or, the first terminal is drain and the second terminal is source.

A second embodiment of the present invention provides an AMOLED display panel, and the AMOLED display panel comprises the OLED driving circuit described above.

The beneficial effects of the embodiments of the present invention are as follows:

Because the OLED driving circuit further comprises offset capacitor and offset TFT's, the variation of the driving current of the OLED caused by threshold voltage shifting of the driving TFT and the voltage drop of the source voltage is offset Because of the arrangement of the offset circuit, the formula for calculating the driving current does not include the threshold voltage of the driving TFT, so that the affection of the threshold voltage shifting of the driving TFT can be offset, the driving current could be more stable, the illuminance of the OLED could be more uniform, and the display quality of the AMOLED display panel could be better. Furthermore, the formula for calculating the driving current does not include the source voltage, either, so that the issue caused by IR drop would not occur although the source voltage is reduced after a long-distance transmission, and, therefore, the driving current could be more stable and the illuminance of the OLED could be more uniform.

BRIEF DESCRIPTION OF THE DRAWINGS

In order to make the descriptions of the technique solutions of the embodiments of the present invention or the existed techniques, the drawings necessary for describing the embodiments or the existed techniques are briefly introduced below. Obviously, the drawings described below are only some embodiments of the present invention, and, for those with ordinary skill in this field, other drawings can be obtained from the drawings described below without creative efforts.

DETAILED DESCRIPTION OF PREFERRED EMBODIMENTS

The technique solutions of the embodiments of the present invention will be clearly and fully described below accompanying with the drawings of the embodiments of the present invention. Obviously, the embodiments described below are only a part, but not all, of the embodiments of the present invention. Other embodiments obtained by those with ordinary skill in this art without creative efforts should belong to the protection scope of the present invention.

The terms "comprise", "have" and variations thereof used in the descriptions, claims and drawings of the present invention are intended to cover non-exclusive inclusions. For example, a process, method, system product or device comprising a series of steps or units is not limited to the listed steps or units but selectively comprises steps or units not listed or selectively comprises other steps or units always in the process, method, product or device. In addition, the terms "first", "second", "third", etc. are used to distinguish different objects but not for describing specific sequence.

Figure 1:
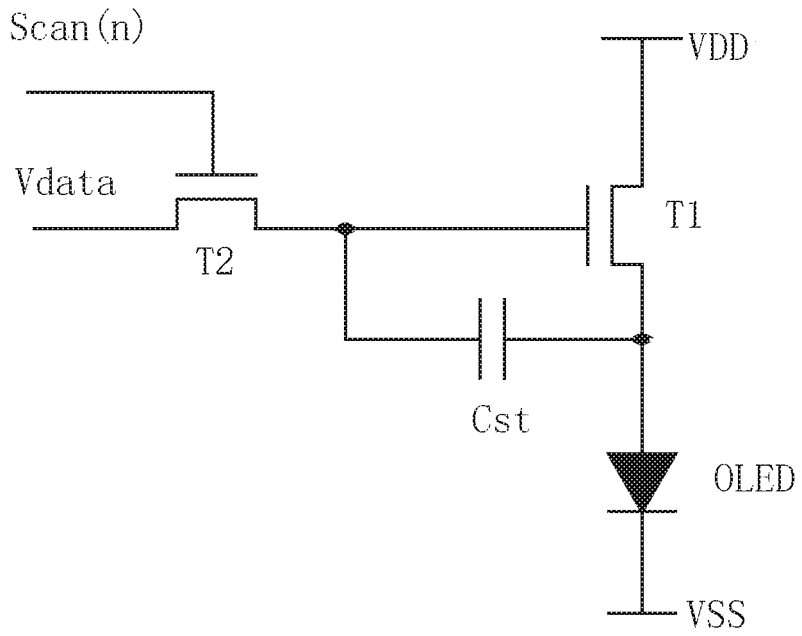
FIG. 1 (Prior Art)
FIG. 1 is a schematic diagram of an OLED driving circuit in the existed technology.
Figure 2:
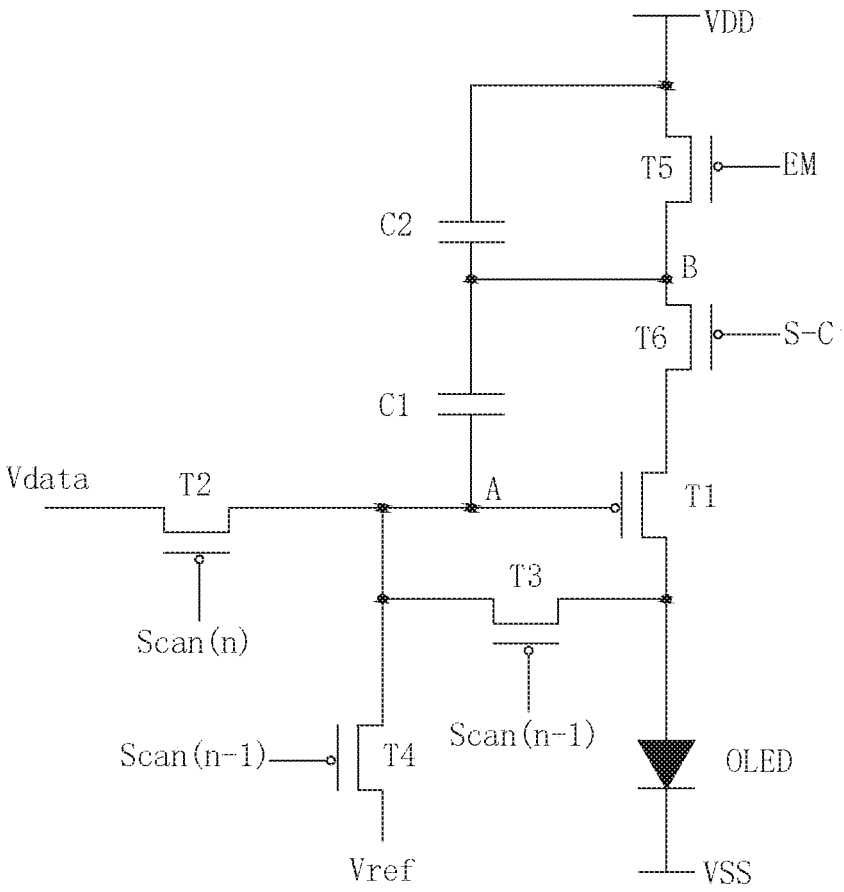
FIG. 2 is a schematic diagram of an OLED driving circuit according to one embodiment of the present invention.

Please refer to FIG. 2, the embodiment of the present invention provides an OLED driving circuit. The OLED driving circuit comprises an OLED, a driving TFT T1 and a switching TFT T2. In the present embodiment, the OLED is used for illuminating; a first terminal of the switching TFT T2 receives a data voltage Vdata, a second terminal of the switching TFT T2 is electrically connected to a gate of the driving TFT T1, a gate of the switching TFT T2 receives a nth scan signal Scan (n), and n is an integer greater than or equal to 2, such as 2, 3, 4, 5, 6, 7, 8, 9 or 10; a first terminal of the driving TFT T1 receives source voltage VDD, which is a high potential voltage in the present embodiment, a second terminal of the driving TFT T1 is electrically connected to a positive electrode of the OLED, and a negative electrode of the OLED receives a low potential voltage VSS. In the present embodiment, the first terminals of the switching TFT T2 and the driving TFT T1 are sources, and the second terminals of the switching TFT T2 and the driving TFT T1 are drains. In other embodiments of the present invention, the first terminals of the switching TFT and the driving TFT could be drains, and the second terminals of the switching TFT and the driving TFT could be sources.

In order to offset uneven luminance because of affections on the driving current of the OLED due to threshold voltage Vth shifting of the driving TFT T1 and voltage drop of the source voltage VDD by long-distance transmitting, the OLED driving circuit in the present embodiment further comprises offset capacitor and offset TFT set for offsetting variations of the driving current of the OLED caused by shifting of the threshold voltage of the driving TFT T1 and the voltage drop of the source voltage VDD.

Specifically, the offset capacitor comprises a first storage capacitor C1 and a second capacitor C2; the first storage capacitor C1 is serially connected with the second storage capacitor C2; a first electrode of the first storage capacitor C1 is electrically connected to the gate of the driving TFT T1, that is, the first electrode of the first storage capacitor is electrically connected to the second terminal of the switching TFT T2; a second electrode of the first storage capacitor C1 is electrically connected to a first electrode of the second storage capacitor C2; and a second electrode of the second storage capacitor C2 receives the source voltage VDD.

In the present embodiment, the offset TFT set comprises a third offset TFT T3, a fourth offset TFT T4, a fifth offset TFT T5 and a sixth offset TFT T6. Wherein, a first terminal of the third offset TFT T3 is electrically connected to the second terminal of the switching TFT T2, that is, the third offset TFT T3 is further electrically connected to the first electrode of the first storage capacitor C1 and the gate of the driving TFT T1; a second terminal of the third offset TFT T3 is electrically connected to the positive electrode of the OLED, and a gate of the third offset TFT T3 receives a (n−1)th scan signal Scan(n−1). A first terminal of the fourth offset TFT T4 receives a reference voltage, which is low potential; a second terminal of the fourth offset TFT T4 is also electrically connected to the second terminal of the switching TFT T2; and a gate of the fourth offset TFT T4 receives the (n−1)th scan signal Scan(n−1). A first terminal of the fifth offset TFT T5 receives the source voltage VDD, a second terminal of the fifth offset TFT T5 is electrically connected to the first electrode of the second storage capacitor C2, and a gate of the fifth offset TFT T5 receives an enable signal EM. A first terminal of the sixth offset TFT T6 is electrically connected to the first electrode of the second storage capacitor C2, that is, the second terminal of the fifth TFT and the first terminal of the sixth offset TFT T6 are both electrically connected to the first electrode of the second storage capacitor C2; a second terminal of the sixth offset TFT T6 is electrically connected to the first terminal of the driving TFT T1; and a gate of the sixth offset TFT T6 receives a reverse signal S-C; wherein the reverse signal S-C is reverse of the nth scan signal Scan(n). For example, when the nth scan signal Scan(n) is high potential at a certain time point, the reverse signal S-C would be low potential at the certain time point. Similarly, when the nth scan signal Scan(n) is low potential at another certain time point, the reverse signal S-C would be high potential at the another certain time point. Therefore, the first terminal of the driving TFT T1 receives the source voltage VDD through the sixth offset TFT T6 and the fifth TFT T5.

Figure 3:
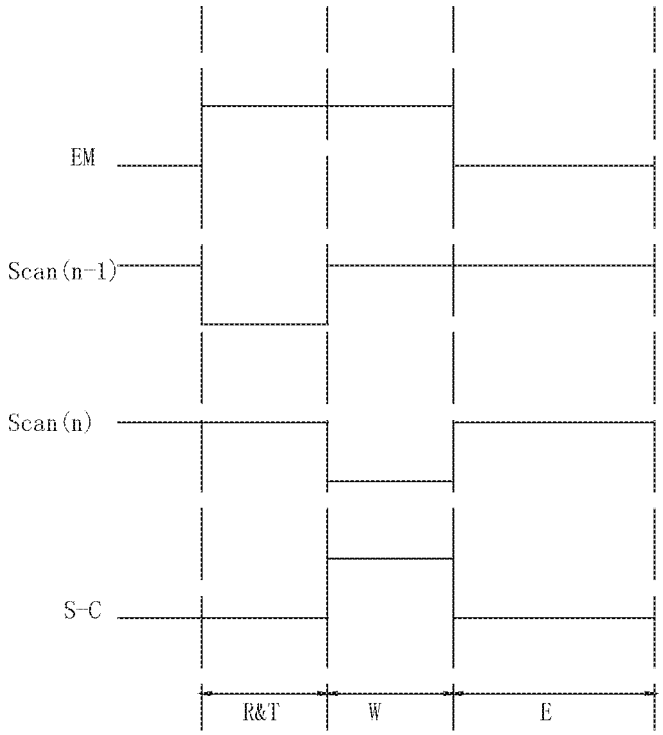
FIG. 3 is a timing diagram of an OLED driving circuit according to one embodiment of the present invention.

In the present embodiment, the OLED in the OLED driving circuit is illuminated cyclically, and one cycle of the OLED driving circuit comprises a reset period R, a threshold voltage obtaining period T, a writing period W and an illuminating period E. Please refer to FIG. 3, driving mechanism of the OLED driving circuit is described with referred to FIG. 2 and FIG. 3.

In the present embodiment, the switching TFT T2, the driving TFT T1, the third offset TFT T3, the fourth offset TFT T4, the fifth offset TFT T5 and the sixth offset TFT T6 are all P-type TFT's.

In the present embodiment, the fifth offset TFT is turned on and the node connecting the first storage capacitor C1 and second storage capacitor C2 stores the source voltage VDD, that is, the voltage at node B in FIG. 2 is the source voltage VDD, before the reset period R and the threshold voltage obtaining period T. In the reset period R and the threshold voltage obtaining period T, the fifth offset TFT T5 is changed to be turned off from being turned on, the (n−1)th scan signal Scan(n−1) and the reverse signal S-C are low potential, and the third offset TFT T3, the fourth offset TFT T4 and the sixth offset TFT T6 are turned on so that the voltage of the gate of the driving TFT T1 is set to be the reference voltage Vref and stored at the first electrode of the first storage capacitor C1. Furthermore, because the sixth offset TFT T6 is turned on, the voltage of the first terminal of the driving TFT T1 would be the same as the voltage between the first storage capacitor C1 and the second storage capacitor C2, that is, the voltage of the first terminal of the driving TFT is the same as the voltage of the node B, and both are the source voltage VDD. In the present embodiment, because the driving TFT T1 is a P-type TFT, the voltage between the gate and the first terminal of the driving TFT T1 should be less than the threshold voltage Vth of the driving TFT in order to obtain the threshold voltage of the driving TFT. That is, $$Vs-Vg>|Vth|;\ \text{such that}$$

$$VDD-V\text{ref}>|Vth|.$$

Because the driving TFT T1 is turned on, the voltage of the node B continuously leaks and the operation of obtaining the threshold voltage Vth of the driving TFT T1 begins. The driving TFT T1 keeps to be turned on until the voltage between the gate and the first terminal of the driving TFT T1 is the same as the threshold voltage of the driving TFT T1. Because the driving TFT T1 is a P-type TFT, Vgs=Vth and the threshold voltage Vth of the driving TFT T1 is obtained when the driving TFT T1 is turned off. Therefore:

$$Vg-Vs=Vth:$$

$$Vs=Vg-Vth:$$

$$Vs=V\text{ref}-Vth.$$

In other words, the voltage of node B is leaked until VB=Vref−Vth, or the voltage between the first storage capacitor C1 and the second storage capacitor C2 is Vref−Vth.

In the present embodiment, in the writing period W, the nth scan signal Scan(n) is low potential, the switching TFT T2 is turned on and other TFT's are turned off. The gate of the driving TFT T1 and the first electrode of the first storage capacitor C1 both receive the data voltage Vdata. The voltages of the gate of the driving TFT T1 and the first electrode of the first storage capacitor C1 become the data voltage Vdata, and, in accordance with the voltage divider rule, the voltage between the first storage capacitor C1 and the second storage capacitor C2 is changed to be:

$$Vref - Vth + \left(\frac{C_2}{C_1 + C_2} \times (Vdata - Vref)\right);$$

wherein, C1 in the above formula is the capacitance of the first storage capacitor and C2 in the above formula is the capacitance of the second storage capacitor.

In other words, the voltage of the node B is changed from Vref−Vth to $$Vref - Vth + \left(\frac{C_2}{C_1 + C_2} \times (Vdata - Vref)\right).$$

In the present embodiment, in the emitting period, the enable signal EM and the reverse signal S-C are low potential so that the fifth offset TFT T5 and the sixth offset TFT T6 are turned on. Because the fifth offset TFT is turned on, the voltage of the first terminal of the driving TFT T1 is suddenly changed to be the source voltage VDD. That is, the voltage of the node B in FIG. 2 is suddenly changed to be the source voltage VDD, and the voltage between the first storage capacitor C1 and the second storage capacitor C2 is suddenly changed to be the source voltage Vdd. According to the coupling effect of capacitor, the voltage of the first electrode of the first storage capacitor C1 is suddenly changed, that is, the voltage of the node A in FIG. 2 is suddenly changed to be:

$$VA = Vdata + \left(VDD - \left(\frac{C_2}{C_1 + C_2} \times (Vdata - Vref) + Vref - Vth\right)\right);$$

$$\text{such that } VA = \frac{C_1}{C_1 + C_2} \times (Vdata - Vref) + VDD + Vth.$$

Therefore, the voltage Vgs is equal to $$\frac{C_1}{C_1 + C_2} \times (Vdata - Vref) + Vth.$$

Because the driving TFT T1 is a P-type TFT, the driving TFT T1 is turned on when $$\frac{C_1}{C_1 + C_2} \times (Vdata - Vref) + Vth < Vth,$$

the OLED illuminates, and the formula for calculating the driving current $I_{OLED}$ is:

$$\begin{aligned} I_{OLED} &= K(Vgs - Vth)^2 \\ &= K(Vg - Vs - Vth)^2 \\ &= K\left(\frac{C_1}{C_1 + C_2} \times (Vdata - Vref) + VDD + Vth - VDD - Vth\right)^2 \\ &= K\left[\frac{C_1}{C_1 + C_2} \times (Vdata - Vref)\right]^2 \end{aligned}$$

Wherein, K is the current amplifying coefficient of the driving TFT T1, Vdata is the data voltage and Vref is the reference voltage.

It can be known from the formula for calculating the driving current $I_{OLED}$ that, because the formula does not include the threshold voltage Vth of the driving TFT T1, the affection of the threshold voltage shifting of the driving TFT T1 can be offset, the driving current $I_{OLED}$ could be more stable, the illuminance of the OLED could be more uniform, and the display quality of the AMOLED display panel could be better. Besides, because the formula for calculating the driving current $I_{OLED}$ does not include the source voltage VDD, either, so that the issue caused by IR drop would not occur although the source voltage VDD is reduced after a long-distance transmission, and, therefore, the driving current $I_{OLED}$ could be more stable and the illuminance of the OLED could be more uniform.

The embodiment of the present invention further provides an AMOLED display panel comprising the OLED driving circuit described above.

It is noted that the embodiments in the descriptions are described in a progressive way, the descriptions addressed in each embodiment are the differences between the embodiment and other embodiments, and the contents similar in the embodiments could be referred to each other. The descriptions made for hardware embodiments are simpler because they are basically similar to the method embodiments and could be referred to the descriptions made in the method embodiments.

According to the descriptions made in the above embodiments, the advantages of the present invention are as follows:

Because the OLED driving circuit further comprises offset capacitor and offset TFT's, the variation of the driving current of the OLED caused by threshold voltage shifting of the driving TFT and the voltage drop of the source voltage is offset Because of the arrangement of the offset circuit, the formula for calculating the driving current does not include the threshold voltage of the driving TFT, so that the affection of the threshold voltage shifting of the driving TFT can be offset, the driving current could be more stable, the illuminance of the OLED could be more uniform, and the display quality of the AMOLED display panel could be better. Furthermore, the formula for calculating the driving current does not include the source voltage, either, so that the issue caused by IR drop would not occur although the source voltage is reduced after a long-distance transmission, and, therefore, the driving current could be more stable and the illuminance of the OLED could be more uniform.

The contents disclosed above are only the preferred embodiments of the present invention, and should not be used for limiting the scope of the present invention. The equivalent variation based on the claimed scope of the present invention should be included in the scope of the present invention.

What is claimed is:

1. An organic light-emitting diode (OLED) driving circuit, comprising an OLED, a switching thin film transistor (TFT) and a driving TFT, wherein a first terminal of the switching TFT receives a data voltage, a second terminal of the switching TFT is electrically connected to a gate of the driving TFT, a gate of the switching TFT receives a nth scan signal, and n is an integer greater than or equal to 2; a first terminal of the driving TFT receives a source voltage, a second terminal of the driving TFT is electrically connected to a positive electrode of the OLED, and a negative electrode of the OLED receives a low potential voltage; wherein, the OLED driving circuit further comprises an offset capacitor and an offset TFT set for offsetting variations of a driving current of the OLED caused by shifting of a threshold voltage of the driving TFT and a voltage drop of the source voltage;

wherein the offset capacitor comprises a first storage capacitor and a second storage capacitor, the first storage capacitor is serially connected with the second storage capacitor, a first electrode of the first storage capacitor is electrically connected to the gate of the driving TFT, a second electrode of the first storage capacitor is electrically connected to a first electrode of the second storage capacitor, and a second electrode of the second storage capacitor receives the source voltage;

wherein the offset TFT set comprises a third offset TFT, a fourth offset TFT, a fifth offset TFT and a sixth offset TFT; a first terminal of the third offset TFT is electrically connected to the second terminal of the switching TFT, a second terminal of the third offset TFT is electrically connected to the positive electrode of the OLED, and a gate of the third offset TFT receives a (n−1)th scan signal; a first terminal of the fourth offset TFT receives a reference voltage, a second terminal of the fourth offset TFT is electrically connected to the second terminal of the switching TFT, and a gate of the fourth offset TFT receives the (n−1)th scan signal; a first terminal of the fifth offset TFT receives the source voltage, a second terminal of the fifth offset TFT is electrically connected to the first electrode of the second storage capacitor, and a gate of the fifth offset TFT receives an enable signal; a first terminal of the sixth offset TFT is electrically connected to the first electrode of the second storage capacitor, a second terminal of the sixth offset TFT is electrically connected to the first terminal of the driving TFT, and a gate of the sixth offset TFT receives a reverse signal; wherein the reverse signal is reverse of the nth scan signal;

wherein a cycle of the OLED driving circuit comprises a reset period, a threshold voltage obtaining period, a writing period and an illuminating period; wherein, in the reset period and the threshold voltage obtaining period, the fifth offset TFT is turned off, the third offset TFT, the fourth offset TFT and the sixth offset TFT are turned on, and the driving TFT is turned off until a voltage between the first terminal and the gate of the driving TFT is the same as the threshold voltage of the driving TFT;

in the writing period, the fourth offset TFT is turned off, the switching TFT is turned on, and the data voltage is transmitted to the gate of the driving TFT and stored in the first storage capacitor;

in the illuminating period, the fifth offset TFT and the sixth offset TFT are turned on, the driving TFT is turned on, the OLED illuminates, and a formula for calculating the driving current IOLED is:

$$I_{OLED} = K\left[\frac{C_1}{C_1 + C_2} \times (Vdata - Vref)\right]^2;$$

wherein, K is a current amplifying coefficient of the driving TFT, Vdata is the data voltage, and Vref is the reference voltage.

2. The OLED driving circuit according to claim 1, wherein the switching TFT, the driving TFT, the third offset TFT, the fourth offset TFT, the fifth offset TFT and the sixth offset TFT are all N-type TFT's.

3. The OLED driving circuit according to claim 1, wherein a difference between the source voltage and the reference voltage is greater than the threshold voltage of the driving TFT.

4. The OLED driving circuit according to claim 1, wherein, in the writing period, a voltage between the first storage capacitor and the second storage capacitor is:

$$Vref - Vth + \left(\frac{C_2}{C_1 + C_2} \times (Vdata - Vref)\right);$$

wherein, Vref is the reference voltage, Vth is the threshold voltage of the driving TFT, C1 is a capacitance of the first storage capacitor, C2 is a capacitance of the second storage capacitor, and Vdata is the data voltage.

5. The OLED driving circuit according to claim 1, wherein, in the illuminating period, a voltage of the gate of the driving TFT affected by coupling effect of the first storage capacitor is:

$$\frac{C_1}{C_1 + C_2} \times (Vdata - Vref) + VDD + Vth;$$

wherein, C1 is a capacitance of the first storage capacitor, C2 is a capacitance of the second storage capacitor, Vdata is the data voltage, Vref is the reference voltage, VDD is the source voltage, and Vth is the threshold voltage of the driving TFT.

6. The OLED driving circuit according to claim 1, wherein the first terminal is source and the second terminal is drain, or, the first terminal is drain and the second terminal is source.

7. An active matrix organic light-emitting diode (AMOLED) display panel, comprising an OLED driving circuit, wherein the OLED driving circuit comprises an OLED, a switching thin film transistor (TFT) and a driving TFT, a first terminal of the switching TFT receives a data voltage, a second terminal of the switching TFT is electrically connected to a gate of the driving TFT, a gate of the switching TFT receives a nth scan signal, and n is an integer greater than or equal to 2; a first terminal of the driving TFT receives a source voltage, a second terminal of the driving TFT is electrically connected to a positive electrode of the OLED, and a negative electrode of the OLED receives a low potential voltage; wherein, the OLED driving circuit further comprises an offset capacitor and an offset TFT set for offsetting variations of a driving current of the OLED caused by shifting of a threshold voltage of the driving TFT and a voltage drop of the source voltage;

wherein the offset capacitor comprises a first storage capacitor and a second storage capacitor, the first storage capacitor is serially connected with the second storage capacitor, a first electrode of the first storage capacitor is electrically connected to the gate of the driving TFT, a second electrode of the first storage capacitor is electrically connected to a first electrode of the second storage capacitor, and a second electrode of the second storage capacitor receives the source voltage;

wherein the offset TFT set comprises a third offset TFT, a fourth offset TFT, a fifth offset TFT and a sixth offset TFT; a first terminal of the third offset TFT is electrically connected to the second terminal of the switching TFT, a second terminal of the third offset TFT is electrically connected to the positive electrode of the OLED, and a gate of the third offset TFT receives a (n−1)th scan signal; a first terminal of the fourth offset TFT receives a reference voltage, a second terminal of the fourth offset TFT is electrically connected to the second terminal of the switching TFT, and a gate of the fourth offset TFT receives the (n−1)th scan signal; a first terminal of the fifth offset TFT receives the source voltage, a second terminal of the fifth offset TFT is electrically connected to the first electrode of the second storage capacitor, and a gate of the fifth offset TFT receives an enable signal; a first terminal of the sixth offset TFT is electrically connected to the first electrode of the second storage capacitor, a second terminal of the sixth offset TFT is electrically connected to the first terminal of the driving TFT, and a gate of the sixth offset TFT receives a reverse signal; wherein the reverse signal is reverse of the nth scan signal;

wherein a cycle of the OLED driving circuit comprises a reset period, a threshold voltage obtaining period, a writing period and an illuminating period; wherein, in the reset period and the threshold voltage obtaining period, the fifth offset TFT is turned off, the third offset TFT, the fourth offset TFT and the sixth offset TFT are turned on, and the driving TFT is turned off until a voltage between the first terminal and the gate of the driving TFT is the same as the threshold voltage of the driving TFT;

in the writing period, the fourth offset TFT is turned off, the switching TFT is turned on, and the data voltage is transmitted to the gate of the driving TFT and stored in the first storage capacitor;

in the illuminating period, the fifth offset TFT and the sixth offset TFT are turned on, the driving TFT is turned on, the OLED illuminates, and a formula for calculating the driving current IOLED is:

$$I_{OLED} = K\left[\frac{C_1}{C_1 + C_2} \times (Vdata - Vref)\right]^2;$$

wherein, K is a current amplifying coefficient of the driving TFT, Vdata is the data voltage, and Vref is the reference voltage.

8. The AMOLED display panel according to claim 7, wherein the switching TFT, the driving TFT, the third offset TFT, the fourth offset TFT, the fifth offset TFT and the sixth offset TFT are all N-type TFT's.

9. The AMOLED display panel according to claim 7, wherein a difference between the source voltage and the reference voltage is greater than the threshold voltage of the driving TFT.

10. The AMOLED display panel according to claim 7, wherein, in the writing period, a voltage between the first storage capacitor and the second storage capacitor is:

$$Vref - Vth + \left(\frac{C_2}{C_1 + C_2} \times (Vdata - Vref)\right);$$

wherein, Vref is the reference voltage, Vth is the threshold voltage of the driving TFT, C1 is a capacitance of the first storage capacitor, C2 is a capacitance of the second storage capacitor, and Vdata is the data voltage.

11. The AMOLED display panel according to claim 7, wherein, in the illuminating period, a voltage of the gate of the driving TFT affected by coupling effect of the first storage capacitor is:

$$\frac{C_1}{C_1 + C_2} \times (Vdata - Vref) + VDD + Vth;$$

wherein, C1 is a capacitance of the first storage capacitor, C2 is a capacitance of the second storage capacitor, Vdata is the data voltage, Vref is the reference voltage, VDD is the source voltage, and Vth is the threshold voltage of the driving TFT.

12. The AMOLED display panel according to claim 7, wherein the first terminal is source and the second terminal is drain, or, the first terminal is drain and the second terminal is source.

* * * * *